United States Patent [19]

Ornstein

[11] Patent Number: 4,792,719

[45] Date of Patent: Dec. 20, 1988

[54] EDGE-BONDED BIMETAL COMPENSATOR FOR SHADOW MASK

[75] Inventor: Jacob L. Ornstein, Reidsville, N.C.

[73] Assignee: GTE Products Corporation, Stamford, Conn.

[21] Appl. No.: 91,145

[22] Filed: Aug. 31, 1987

[51] Int. Cl.[4] ..... H01J 29/07; H01J 29/82

[52] U.S. Cl. ..... 313/405; 313/406

[58] Field of Search ..... 313/405, 406

[56] References Cited

U.S. PATENT DOCUMENTS

| | | | |
|---|---|---|---|
| 3,573,527 | 4/1971 | Hafkenscheid et al. | 313/405 |
| 3,617,787 | 11/1971 | Plukker | 313/405 |
| 3,700,948 | 10/1972 | Palac | 313/405 |
| 4,012,661 | 3/1977 | Danielson, Jr. et al. | 313/405 |
| 4,315,189 | 2/1982 | Goto et al. | 313/405 |
| 4,491,763 | 1/1985 | Fujinuma et al. | 313/405 |
| 4,572,983 | 2/1986 | Ragland, Jr. | 313/405 |

*Primary Examiner*—Palmer C. DeMeo

*Attorney, Agent, or Firm*—James Theodosopoulos

[57] ABSTRACT

A compensator for a shadow mask for a color television picture tube comprises an elongated bimetal support member comprising a high expansion austenitic stainless steel alloy extending the length and half the width of the support member and a low expansion age hardenable stainless steel alloy extending the length and half the width of the support member, the two alloys being edge bonded to each other.

4 Claims, 1 Drawing Sheet

EDGE-BONDED BIMETAL COMPENSATOR FOR SHADOW MASK

BACKGROUND OF THE INVENTION

This invention concerns bimetals used as support members for shadow masks in color television tubes. Such bimetal support members are used to compensate for the thermal expansion of the shadow masks during operation. Examples of such compensators are shown in U.S. Pat. Nos. 3,330,980, 3,524,972, 3,524,973, 3,524,974, 3,700,948, 3,781,583, 3,823,336, 3,838,985, 4,285,106 and 4,645,120. This invention is particularly concerned with bimetal support members that are edge bonded, as shown in U.S. Pat. No. 3,700,948, instead of surface bonded, as shown in the other patents.

The edge bonded bimetal shown in U.S. Pat. No. 3,700,948 is a flat rectangular member and is used in smaller picture tubes. The high expansion alloy typically consisted of type 304 stainless steel, which is 18–20 Cr, 8–10 Ni, balance Fe. The low expansion alloy typically consisted of type 430 stainless steel, which is 14–18 Cr, balance Fe. Such a bimetal is not suitable in larger picture tubes, say, the 27" size. This invention discloses a bimetal support member suitable for use in such larger picture tubes.

SUMMARY OF THE INVENTION

A compensator for shadow masks in accordance with this invention comprises a high expansion austenitic stainless steel edge bonded to a low expansion age hardenable stainless steel. After the compensator has been formed, it is heat treated to harden the age hardenable stainless steel, thereby increasing its strength sufficiently for use in large picture tubes.

DESCRIPTION OF THE PREFERRED EMBODIMENT

Figure 1:
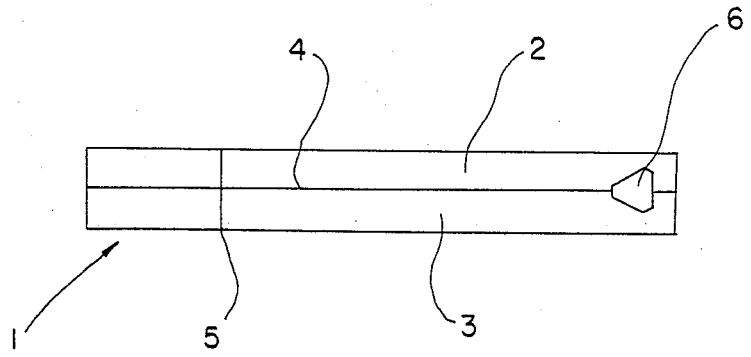
FIG. 1 is a plan view.
Figure 2:
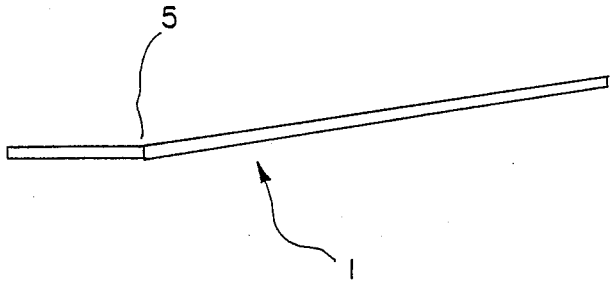
FIG. 2 is an elevational view of a compensator in accordance with this invention. elevational view of a compensator in accordance with this invention.

One example of a compensator in accordance with this invention comprised an elongated bimetal support member 1 about 4" long by ½" wide by 50 mils thick. The high expansion alloy 2 of the compensator comprised type 305 stainless steel and comprised about half the width of the compensator. The low expansion alloy 3, the other half, comprised an age hardenable stainless steel having the following composition: chromium 14–16%; nickel 5–7%; molybdenum 0.5–1%; copper 1.25–1.75%; balance iron. The two alloys were edge bonded at 4 by electron beam welding and then straightened. The elongated bimetal support member was then stamped out and a low angle bend 5, about 10°, was formed about ⅞" from one end.

Bend 5 was necessary to provide the proper twisting motion during compensation. There was a hole through the support member at the other end to mate with a stud in the picture tube when the shadow mask is mounted in the picture tube. The compensator was age hardened at 900° F. to significantly increase the yield strength of the age hardenable low expansion stainless steel alloy. The strength of this compensator was about 50% greater than that of the compensator utilizing type 430 stainless steel as the low expansion alloy. The yield strength of the age hardenable low expansion stainless steel alloy itself was also increased at least about 50% by the age hardening.

I claim:

1. A compensator for a shadow mask for a color television picture tube comprising an elongated bimetal support member comprising a high expansion austenitic stainless steel alloy extending the length and half the width of the support member and a low expansion age hardenable stainless steel alloy extending the length and half the width of the support member, the two alloys being edge bonded to each other, the support member having been age hardened after formation of the support member to increase the yield strength of the age hardenable stainless steel alloy at least about 50% over the yield strength of the age hardenable stainless steel alloy prior to age hardening.

2. The compensator of claim 1 wherein the composition of the age hardenable low expansion stainless steel alloy is 14–16% chromium, 5–7% nickel, 0.5–1% molybdenum, 1.25–1.75% copper, balance iron.

3. The compensator of claim 1 wherein the elongated bimetal support member has a low angle bend near one end thereof.

4. The compensator of claim 3 wherein there is a hole through the support member near the other end thereof to mate with a stud in a color television picture tube.

* * * * *